US008240581B2

(12) United States Patent
Markley

(10) Patent No.: US 8,240,581 B2
(45) Date of Patent: Aug. 14, 2012

(54) APPARATUS AND A SYSTEM ENABLING A USER TO DRINK MULTIPLE LIQUIDS THROUGH A SINGLE STRAW

(75) Inventor: Martin Joseph Markley, Overland Park, KS (US)

(73) Assignee: Martin Joseph Markley, Overland Park, KS (US)

( * ) Notice: Subject to any disclaimer, the term of this patent is extended or adjusted under 35 U.S.C. 154(b) by 0 days.

(21) Appl. No.: 13/162,342

(22) Filed: Jun. 16, 2011

(65) Prior Publication Data

US 2011/0240754 A1 Oct. 6, 2011

Related U.S. Application Data

(63) Continuation of application No. 12/796,808, filed on Jun. 9, 2010.

(60) Provisional application No. 61/268,490, filed on Jun. 13, 2009.

(51) Int. Cl.

| | |
|---|---|
| ***B05B 12/14*** | (2006.01) |
| ***E03B 9/20*** | (2006.01) |
| ***F16K 11/065*** | (2006.01) |
| ***F16K 31/00*** | (2006.01) |
| ***F16D 65/00*** | (2006.01) |

(52) U.S. Cl. ..... 239/29; 239/33; 251/345; 137/625.18; 137/597

(58) Field of Classification Search ..... 239/24, 239/29, 33, 29.3, 16, 436, 443, 444–447, 239/390–397; 251/4, 9, 142, 149.5, 153, 251/208, 228, 345; 137/597, 594, 595, 625.18, 137/628.19, 625.4, 625.41; 138/44–46; 222/134, 222/138–141, 144.5, 145.3
See application file for complete search history.

(56) References Cited

U.S. PATENT DOCUMENTS 1,633,074 A * 6/1927 De Mott ..... 604/32
(Continued)

FOREIGN PATENT DOCUMENTS

KR 10-0821874 B1 6/2008
(Continued)

OTHER PUBLICATIONS

Notification of Transmittal of the International Search Report and the Written Opinion of the International Searching Authority, or the Declaration dated Feb. 28, 2011, in corresponding International Patent Application No. PCT/US2010/038118; International filing date: Jun. 10, 2010; Applicant: Martin J. Markley.

*Primary Examiner* — Dinh Q Nguyen
*Assistant Examiner* — Justin Jonaitis

(57) ABSTRACT

A system includes a portable liquid container having at least two chambers for containing at least two liquids separate and an apparatus having at least two separate input tubes configured for drawing liquid from the chambers. At least two separate output tubes are configured for passing at least two separate liquids to a user's mouth. A valve assembly includes a lower portion having at least two input connectors each joined to a one of the input tubes. An upper portion has at least two output connectors each joined to a one of the output tubes. An adjustable valve portion determines proportions of liquids in the separate chambers that are passed to the user's mouth where the liquids remain separate until reaching the user's mouth, and where liquids drawn back down the input tubes and the output tubes into the chambers remain substantially separated.

9 Claims, 4 Drawing Sheets

U.S. PATENT DOCUMENTS

| | | | | | |
|---|---|---|---|---|---|
| 2,558,645 | A | | 6/1951 | Docter | |
| 3,260,460 | A | | 7/1966 | Marland | |
| 3,260,462 | A | * | 7/1966 | Smaczny | 239/33 |
| 4,196,747 | A | | 4/1980 | Quigley et al. | |
| 4,699,318 | A | | 10/1987 | Donatello et al. | |
| 4,739,905 | A | * | 4/1988 | Nelson | 222/145.4 |
| 4,955,503 | A | | 9/1990 | Propes | |
| 5,160,087 | A | | 11/1992 | Mandell | |
| 5,251,670 | A | * | 10/1993 | Bates et al. | 137/625.46 |
| 5,398,846 | A | * | 3/1995 | Corba et al. | 222/1 |
| 5,433,350 | A | * | 7/1995 | Graubart | 222/136 |
| 6,042,018 | A | | 3/2000 | Weinstein | |
| 2006/0151496 | A1 | | 7/2006 | Healy et al. | |

FOREIGN PATENT DOCUMENTS

| | | |
|---|---|---|
| WO | WO 2008/070057 A3 | 6/2008 |

* cited by examiner

APPARATUS AND A SYSTEM ENABLING A USER TO DRINK MULTIPLE LIQUIDS THROUGH A SINGLE STRAW

RELATED APPLICATIONS

This application is a continuation, and claims priority benefit with regard to all common subject matter, of U.S. patent application Ser. No. 12/796,808, filed Jun. 9, 2010, and entitled "An Apparatus and a System Enabling a User to Drink Multiple Liquids Through a Single Straw." The '808 Application claims priority benefit of U.S. Provisional Patent Application Ser. No. 61/268,490, filed on Jun. 13, 2009, under 35 U.S.C. §119(e), and entitled "Swap Straw." The contents of the above-referenced provisional application are incorporated herein by reference for all purposes. The above-referenced non-provisional patent application is also hereby incorporated by reference in its entirety into the present application.

FIELD OF THE INVENTION

The present invention relates generally to drinking straws. More particularly, the invention relates to a drinking apparatus with multiple tubes.

BACKGROUND OF THE INVENTION

The present invention relates to a drinking straw assembly that enables a user to determine how much liquid is drawn from a multiple chamber container utilizing a valve chamber assembly, which is designed with multiple tubes entering and one straw exiting. In some cases in which a user is drinking multiple flavored liquids from a multichambered container or from multiple containers, the user may wish to drink all of the liquids at the same time or may wish to drink one liquid by itself. It would be simpler for the user to be able to do this with one straw, rather than using multiple straws. It would also be desirable for the user to be able to change the flow pattern of the liquids to control the amount of each liquid being drawn up. Furthermore, the straw should preferably ensure that the liquids are not mixed in the container prior to drinking by maintaining separation at all times, especially during the draw down of the liquids back into the container. It is therefore an objective of the present invention to provide means for drinking multiple liquids of different flavors from a multi-chambered container or multiple containers with a single straw without mixing the liquids.

There are many styles of drinking straws in the market that are designed with different colors, lengths, ornamental designs, and even the option of being edible. For example, without limitation, one existing drinking straw enables multiple people to drink from a single reservoir with separate tubes. Another existing drinking device comprises a forked style straw that is inserted into separate containers. The liquids in said containers are drawn up through the straw, and mixed in a center chamber prior to the opening from which a user drinks. This design does not keep the different liquids separate because, when the liquid in the straw is drawn back down after drinking, it goes into the containers as a mixed liquid rather than as two separate liquids. Furthermore, the user cannot choose which liquid is drawn up as the straw always draws up a mixture of the liquids.

Another current device comprises a drinking assemblage and system in which a user can have multiple straws that can be inserted into separate containers and the liquids stay separated at all times. The user drinks from the multiple straws and they join in the mouth. However, this device is rather simple and does not truly differentiate itself from using separate straws.

Other currently known devices provide drinking apparatuses with multiple straws enabling more than one user to drink liquids from the same container. The straws are connected to a base unit, and only one liquid can be drawn into the straws by multiple users. A specific device to enable more than one user to drink comprises a drinking straw with a plurality of outlet mouthpieces that join in the middle at a heart shape and then converge into one straw that is inserted into the liquid. This prior art does not enable multiple liquids to be drunk through the same straw apparatus or segregate multiple liquids.

Yet another prior art device comprises one straw with a check valve located at the bottom of the straw near the bottom of the container. When a user drinks from the mouthpiece of the straw, liquid travels to the mouth, and when the user stops drinking, the liquid does not retreat back into the container because the check valve allows liquid to travel upward yet not back into the container. The liquid remains in the entire length of the straw, so when the user begins drinking again, there is liquid already near the mouthpiece. This device is designed for people with emphysema or respiratory problems that do not have much lung capacity so they do not have to draw the liquid through the entire length of the straw every time they drink.

In view of the foregoing, there is a need for improved techniques for providing a drinking device that enables a user to drink multiple liquids through a single straw while keeping the liquids separate from each other.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a side perspective view, and FIG. 1B is an exploded view;

FIG. 2A is a front view, and FIG. 2B is a top view;

Figure 1A:
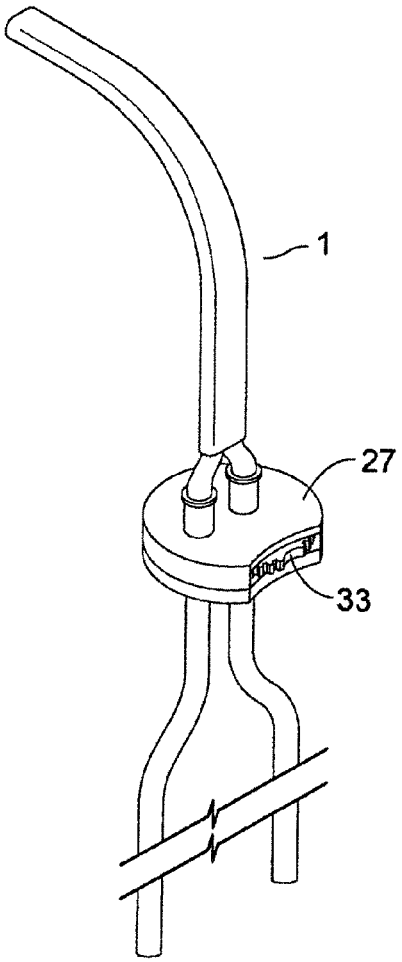
FIGS. 1A and 1B illustrate an exemplary multi port drinking apparatus, in accordance with a first embodiment of the present invention.

Unless otherwise indicated illustrations in the figures are not necessarily drawn to scale.

SUMMARY OF THE INVENTION

To achieve the forgoing and other aspects and in accordance with the purpose of the invention, an apparatus and a system enabling a user to drink multiple liquids through a single straw is presented.

In one embodiment an apparatus includes means for drawing liquid from separate liquid containers, means for passing at least two separate liquids to a user's mouth, and means for determining proportions of liquids in the separate liquid containers that are passed to the user's mouth where the liquids remain separate until reaching the user's mouth and where liquids drawn back down the drawing means and the passing means into the separate liquid containers remain substantially separated.

In another embodiment an apparatus includes at least two separate input conduits configured for drawing liquid from separate liquid containers. At least two separate output conduits are configured for passing at least two separate liquids to a user's mouth. A valve assembly includes a lower portion having at least two input connectors each joined to a one of the input conduits. An upper portion has at least two output connectors each joined to one of the output conduits. An adjustable valve portion determines proportions of liquids in the separate liquid containers that are passed to the user's mouth where the liquids remain separate until reaching the user's mouth, and where liquids drawn back down the input and output conduits into the separate liquid containers remain substantially separated.

In another embodiment a system includes a portable liquid container having at least two chambers for containing at least two liquids separate. At least two separate input tubes are configured for drawing liquid from the chambers. At least two separate output tubes are configured for passing at least two separate liquids to a user's mouth. A valve assembly includes a lower portion having at least two input connectors each joined to one of the input tubes. An upper portion has at least two output connectors each joined to one of the output tubes. An adjustable valve portion determines proportions of liquids in the separate chambers that are passed to the user's mouth where the liquids remain separate until reaching the user's mouth, and where liquids drawn back down the input tubes and the output tubes into the chambers remain substantially separated.

Other features, advantages, and aspects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include substeps and subservient means. All conjunctions used are to be understood in the most inclusive sense possible. Thus, the word "or" should be understood as having the definition of a logical "or" rather than that of a logical"exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

As is well known to those skilled in the art many careful considerations and compromises typically must be made when designing for the optimal manufacture of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide a drinking assembly that enables a user to consume liquids from a container comprising multiple chambers or from multiple containers and to drink multiple liquids at the same time or individually by manipulating a valve assembly. The user can choose multiple flavored liquids to fill the multi chamber container. Preferred embodiments provide a drinking apparatus comprising multiple tubes, which converge into a valve assembly then exit as an individual straw from which the user may draw liquids. The valve assembly in preferred embodiments dictates the amount of liquid drawn from any chamber and this setting may be manipulated by the user into any percentage of the liquids drawn individually or as a whole. In preferred embodiments, the valve assembly also generally prohibits the separated liquids from mixing in the container upon draw down to maintain the individual flavors of the liquids.

Preferred embodiments of the present invention enable a user to experience the mixing of separate flavors at the mouth from the same container without mixing the liquids prior to drinking. Preferred embodiments also enable the user to alternate the liquids being drawn into the straw separately, enhancing the individuality of the flavors. Preferred embodiments also generally keep the liquids separated even after the user stops the drinking action and the liquids are drawn back into the container. In preferred embodiments the apparatus comprises a plurality of conduits joined at a valve assembly. The conduits may be formed into any shape which accommodates the passage of liquids; however, the conduits are typically cylindrical in design for easy flow.

Preferred embodiments of the present invention are designed to keep multiple liquids separated while drinking them. A non-limiting example of a liquid that may be drunk using a preferred embodiment is a Slurpee® from 7-11®. For example, without limitation, the user can put their favorite Slurpee® flavors in the multi chamber container with one side filled with one flavor such as, but not limited to, banana and the other side filled with another flavor such as, but not limited to, cherry. Other types of beverages that may be separated and drunk using preferred embodiments of the present invention include, without limitation, rum and coke, vodka and orange juice, whiskey and water, different flavors of milkshakes, iced tea and lemonade, and numerous others. Preferred embodiments are preferably made of transparent plastic to enable a user to watch the liquids travel through the conduits for entertainment; however, various different materials may be used such as, but not limited to, other types of plastic, glass, metal, etc.

Figure 1B:
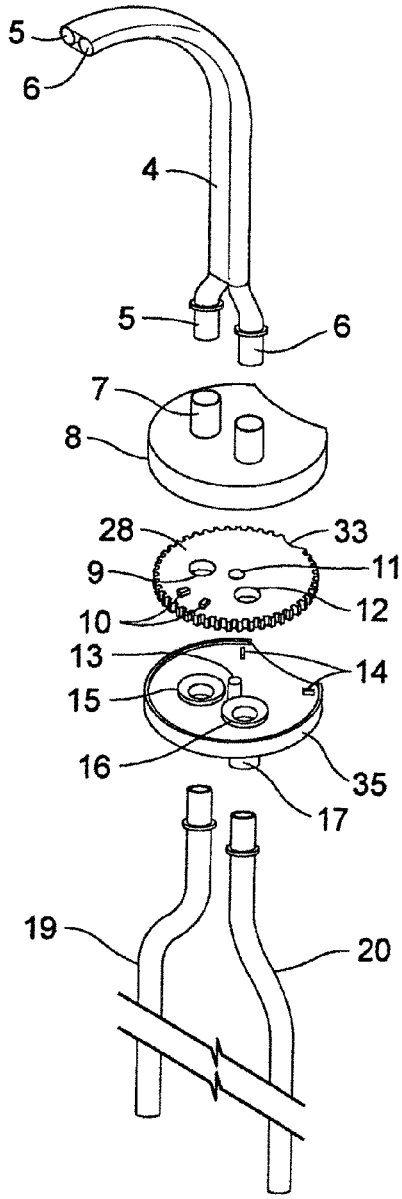

FIGS. 1A and 1B illustrate an exemplary multi port drinking apparatus 1, in accordance with an embodiment of the present invention. FIG. 1A is a side perspective view, and FIG. 1B is an exploded view. In the present embodiment, multi port drinking apparatus 1 comprises a plurality of tubular members 4, 5, 6, 7, 17, 19, and 20 that enable a user to obtain liquids from a single multi chamber container as shown, by way of example, in FIGS. 2A and 2B or multiple containers at the same time without mixing the liquids until they are dispensed into the user's mouth through the output chambers of upper conduits 5 and 6. Drinking apparatus 1 comprises a plurality of conduits 5, 6, 19, and 20 that are joined together at a valve assembly 27, which generally keeps the liquids being drunk through drinking apparatus 1 separate at all times. Lower conduits 19 and 20, which are inserted into the liquid container, are designed to remain separate from one another by fixed means of attachment 17 to valve assembly 27. Upper conduits 5 and 6 are coupled to valve assembly 27 by fixed means of attachment 7.

Valve assembly 27 comprises an internal valve dial 28 with openings 9 and 12, which are equal in diameter to the size of conduits 5, 6, 19, and 20 attached to valve assembly 27. Openings 9 and 12 dictate the amount of liquid flowing into upper conduits 5 and 6 when drinking apparatus 1 is being utilized. Valve dial 28 comprises a notch 33 to indicate a center position that allows full flow of both liquids through both openings 9 and 12. As valve dial 28 is turned in either direction, it blocks the flow of liquid from one of lower conduits 19 or 20 and allows the liquid in the other lower conduit 19 or 20 to flow. Valve dial 28 can be turned in the opposite direction to change the lower conduit 19 or 20 through which the liquid is drawn. Valve dial 28 has the same number of openings as there are lower conduits. In the present embodiment, drinking apparatus 1 comprises two lower conduits 19 and 20; therefore, there are two openings 9 and 12 in valve dial 28. However, alternate embodiments may comprise more than two lower conduits and more openings in the valve dial. These alternate embodiments may also comprise more than two upper conduits. In the present embodiment, the upper half of drinking apparatus 1, above valve assembly 27, comprises an equal number of upper conduits as lower conduits in the lower half. However, alternate embodiments may be implemented with a different number of conduits on the upper portion than is on the lower portion.

Figure 4:
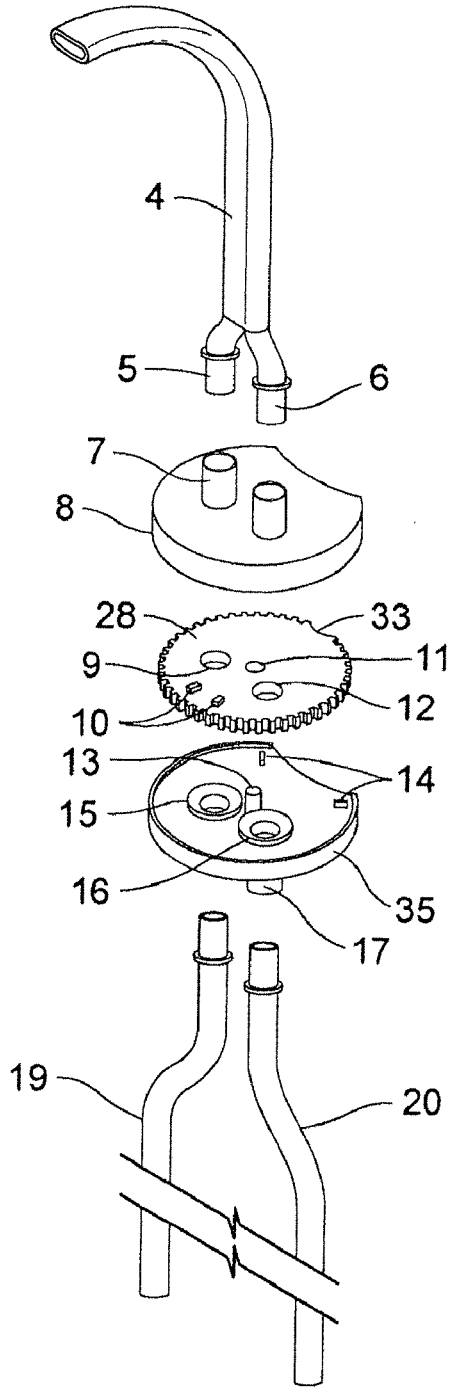
FIG. 4 is an exploded view of a second embodiment of the present invention and particularly illustrating a single upper conduit.

In the present embodiment, upper conduits 5 and 6 enable the flow of the liquids to pass from valve assembly 27 to the user's mouth. Upper conduits 5 and 6 are affixed to valve assembly 27 by fixed means of attachment 7 and are joined together as one conduit, yet maintain their individual access to the liquids. In the present embodiment upper conduits 5 and 6 remain separate tubes and are joined by being inserted into a joining straw 4. Maintaining the separation of upper conduits 5 and 6 generally eliminates the mixing of the liquids after the user stops the drinking action and the liquids are drawn back down through valve assembly 27, through lower conduits 19 and 20 and ultimately back into the container. In alternate embodiments the upper conduits may be joined together as a single straw with a divider to maintain the separation of the liquids. In other alternate embodiments and as illustrated in FIG. 4, the upper conduits may be combined into a single straw in which the liquids are allowed to mix. These embodiments may also comprise a cheek valve at the lower end of the single straw to generally prevent the mixed liquid from drawing back down into the valve assembly.

In the present embodiment, valve assembly 27 comprises an upper housing 8 and a lower housing 35 that encase valve dial 28. Valve dial 28 is held secure with an internal stud 13 centered within housings 8 and 35 and is able to rotate freely about a dial opening 11, which is placed on internal stud 13.

As valve dial 28 rotates, liquid passages 15 and 16 in lower housing 35 remain stationary and are opened or closed depending upon the position of valve dial 28. There are corresponding stationary liquid passages (not shown) in upper housing 8 that align with fixed attachment means 7 and upper conduits 5 and 6. With valve dial 28 in the centered position as indicated when notch 33 is facing away from valve assembly 27, both liquid passages 15 and 16 allow liquid to pass through. In alternate embodiments various different types of indicators other than a notch or in addition to a notch may be used to denote the centered position such as, but not limited to, numbers, dots, arrows, etc. In the present embodiment, as the user rotates valve dial 28 in either direction, liquid passages 15 and 16 are restricted by their misalignment with openings 9 and 12 in valve dial 28 until valve dial 28 is stopped when stops 10 on valve dial 28 come into contact with stops 14 on upper housing 8 and lower housing 35. When valve dial 28 is stopped by stops 10 and 14 only one liquid passage 15 or 16, depending on which direction valve dial 28 has been rotated, is aligned with an opening 9 or 12 to allow liquid to move through it. Rotating valve dial 28 in the opposite direction opens the opposite liquid passage 15 or 16. Restricting and opening liquid passages 15 and 16 controls the flow of liquid through the corresponding upper conduits 5 and 6. Valve dial 28 can be freely manipulated with any digit of the hand.

In the present embodiment, drinking apparatus 1 can be made of a multitude of materials such as, but not limited to, various different plastics, glass, metal etc. However, drinking apparatus 1 is preferably made of a clear, strong material such as, but not limited to, polystyrene so drinking apparatus 1 is durable, reusable and see-through for the enjoyment of the user. In some embodiments, certain elements of the drinking apparatus may be made of different materials. For example, without limitation, the upper and lower valve housings may be made of opaque materials to hide the inner workings of the valve assembly.

Figure 2A:
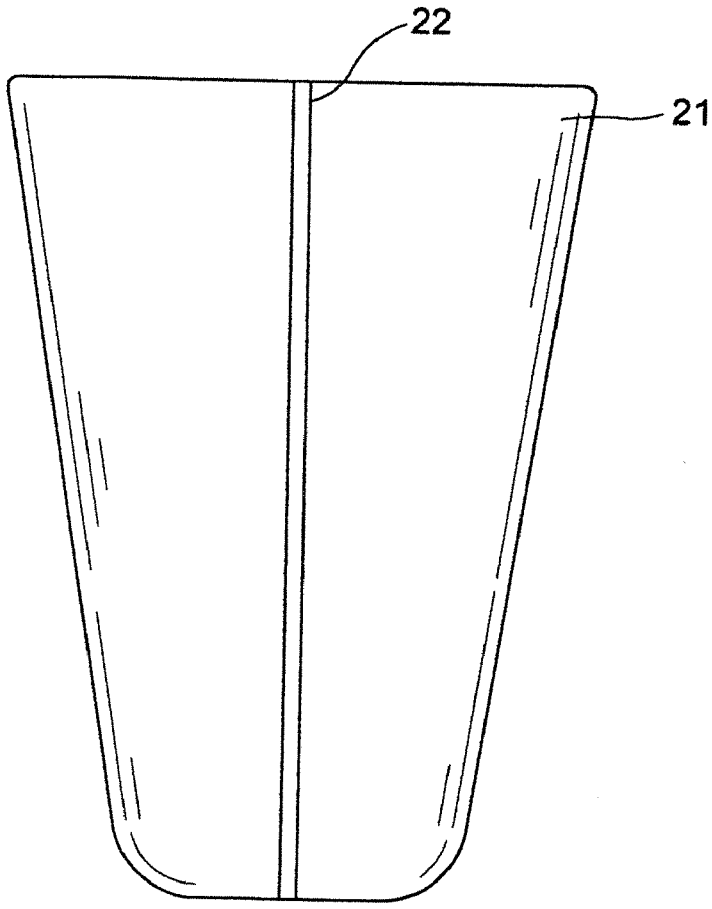
FIGS. 2A and 2B illustrate an exemplary portable liquid container with multiple chambers, in accordance with an embodiment of the present invention.
Figure 2B:
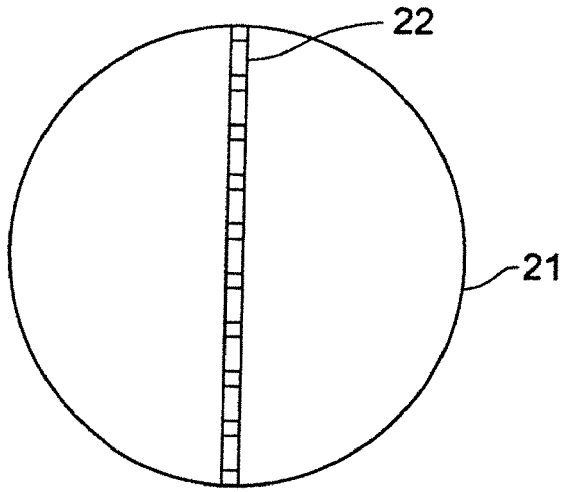

FIGS. 2A and 2B illustrate an exemplary portable liquid container 21 with multiple chambers, in accordance with an embodiment of the present invention. FIG. 2A is a front view, and FIG. 2B is a top view. In the present embodiment, container 21 comprises a divider 22 that keeps liquids placed in the chambers of container 21 separated. Divider 22 extends from the bottom of container 21 to the top of container 21 to generally prevent any transfer of liquid from one chamber to the other chamber. However, in alternate embodiments the divider may not reach all the way to the top of the container to leave space for attaching a lid to the top of the container. In the present embodiment, divider 22 splits container 21 in half; however, in alternate embodiments the divider may be placed off-center to create one chamber that is larger than the other chamber. Those skilled in the art, in light of the present teachings, will readily recognize that containers in alternate embodiments can be made with multiple dividers and more than two chambers. These containers may be used with drinking apparatuses that have more than two lower conduits.

Figure 3:
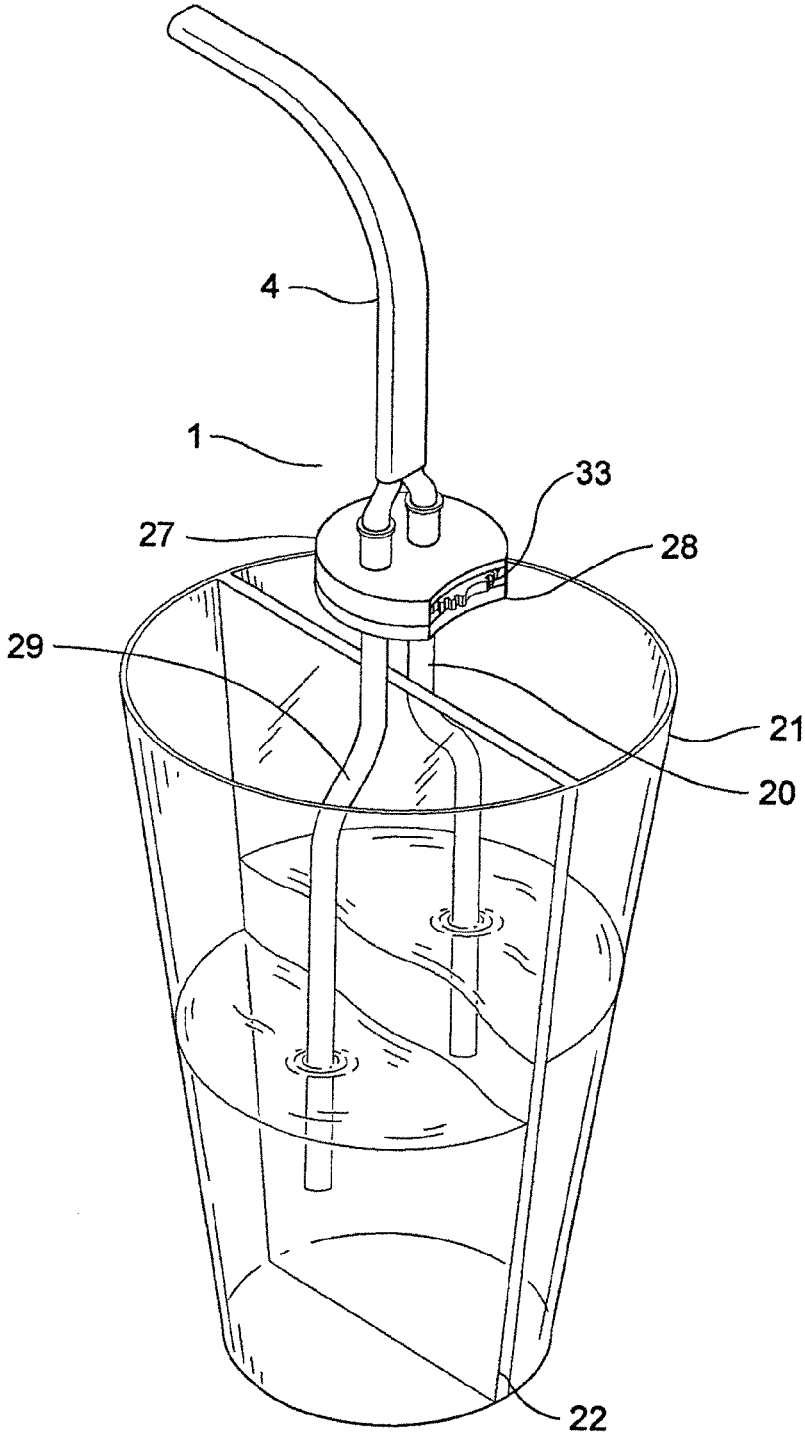
FIG. 3 is a front perspective view of an exemplary multi port drinking apparatus in use in a multi chamber container, in accordance with an embodiment of the present invention.

FIG. 3 is a front perspective view of an exemplary multi port drinking apparatus 1 in use in a multi chamber container 21, in accordance with an embodiment of the present invention. In typical use of the present embodiment, a user dispenses separate liquids into each side of container 21 then inserts lower conduits 19 and 20 into container 21 with one conduit on each side of a divider 22. When the user begins drinking from an upper straw 4 of drinking apparatus 1 with a valve dial 28 in a centered position as indicated by a notch 33 being centered on the outside of a valve assembly 27, the user is able to drink from both chambers of container 21 to taste both flavors at the same time. When the user rotates valve dial 28 in either direction until it reaches its maximum rotation, the user can drink from only one chamber of container 21 to taste only one flavor. By rotating valve dial 28 in the opposite direction until it reaches its maximum rotation, the user may drink from the other chamber of container 21 to taste the other flavor. Positioning valve dial 28 at different points between the centered position and the points of maximum rotation enables the user to vary the ratio of the amount of each liquid reaching his mouth. Regardless of the position of valve dial 28 when the user stops drinking, the liquids return to their respective chambers in container 21, generally eliminating the commingling of liquids.

Having fully described at least one embodiment of the present invention, other equivalent or alternative methods of providing multi port liquid transporting apparatuses according to the present invention will be apparent to those skilled in the art. The invention has been described above by way of illustration, and the specific embodiments disclosed are not intended to limit the invention to the particular forms disclosed. For example, the particular implementation of the apparatus may vary depending upon the particular type of application for which it is used. The applications described in the foregoing were directed to drinking straw implementations; however, similar techniques are to use multi port liquid transporting apparatuses in various different applications. For example, without limitation, a pump, which may be hand, electrically, or otherwise powered, may be placed on the top of the upper portion of the apparatus to enable different liquids to be pumped from a multi chamber container or from multiple containers. Furthermore, large versions of multi port apparatuses may be adapted for industrial use. Non-drinking straw implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

The invention claimed is:

1. A drinking apparatus for use with a drinking container having at least two divided chambers, with a first chamber containing a first fluid and a second chamber containing a second fluid, the drinking apparatus comprising:

a first input conduit for insertion in the first chamber of the drinking container for fluidly interacting with the first fluid;

a second input conduit for insertion in the second chamber of the drinking container for fluidly interacting with the second fluid;

an output conduit having an elongated primary section, a proximal end, and a distal end, wherein the proximal end of the output conduit is for insertion in a user's mouth, wherein the distal end of the output conduit includes first and second spaced attachments, said first attachment being disposed between and in fluid communication with the first input conduit and with the elongated primary section of the output conduit so as to communicate the first fluid from the first input conduit and to the elongated primary section, and the second attachment being disposed between and in fluid communication with the second input conduit and with the elongated primary section of the output conduit so as to communicate the second fluid from the second input conduit and to the elongated primary section; and a valve assembly fluidly disposed between the first and second input conduits and the output conduit, the valve assembly including— a body having a generally lower portion and a generally upper portion, a first input connector positioned at the generally lower portion of the body and fluidly coupled with the first input conduit, a second input connector positioned at the generally lower portion of the body and fluidly coupled with the second input conduit, a first output connector positioned at the generally upper portion of the body and fluidly coupled with the first attachment of the output conduit, a second output connector positioned at the generally upper portion of the body and fluidly coupled with the second attachment of the output conduit, a selectively rotatable valve member housed within the body and having first and second fluid passages, wherein the first fluid passage is different than the second fluid passage, said rotatable valve member being rotatable to a first position wherein the first fluid passage is in fluid communication with the first input connector and the first attachment of the output conduit, a second position wherein the second fluid passage is in fluid communication with the second input connector and the second attachment of the output conduit, and a third position wherein the first fluid passage is in fluid communication with the first input connector and the first attachment of the output conduit and the second fluid passage is in fluid communication with the second input connector and the second attachment of the output conduit, wherein when the rotatable valve member is in the first position, the second fluid passage is misaligned with the second input connector, such that only the first fluid can be drawn through the first input conduit, and further wherein the first fluid is drawn through the first input connector, through the first fluid passage, through the first attachment of the output conduit, and through the elongated primary section of the output conduit, wherein when the rotatable valve member is in the second position, the first fluid passage is misaligned with the first input connector, such that only the second fluid can be drawn through the second input conduit, and further wherein the second fluid is drawn the second input connector, through the second fluid passage, through the second attachment of the output conduit, and through the elongated primary section of the output conduit, wherein when the rotatable valve member is in the third position, the first fluid passage is in fluid communication with the first input connector, such that the first fluid can be drawn through the first input conduit, and the second fluid passage is in fluid communication with the second input connector, such that the second fluid can be drawn through the second input conduit, and an actuator for actuating the adjustable valve to selectively allow for drawing of a fluid through either only the first input conduit, only the second input conduit, or both of the first and second input conduits at the same time.

2. The drinking apparatus of claim 1, wherein the elongated primary section of the output conduit is a single conduit, such that fluid drawn through both the first and second input conduits at the same time and subsequently to the single conduit of the output conduit is mixed prior to exiting the single conduit.

3. The drinking apparatus of claim 1, wherein the output conduit has first and second divided output conduits, such that fluid drawn through both the first and second input conduits and subsequently to the first and second output conduits remains separated until exiting the first and second output conduits.

4. The drinking apparatus of claim 1, wherein upon selective actuation of the actuator to provide for fluid being drawn only through the first input conduit, any fluid drawn back down through the output conduit is further drawn back down into the first input conduit, and wherein upon selective actuation of the actuator to provide for fluid being drawn only through the second input conduit, any fluid drawn back down through the output conduit is further drawn back down into the second input conduit.

5. The drinking apparatus of claim 1, the valve assembly further including an indicator to assist the user in the selection of the fluid from either only the first input conduit, only the second input conduit, or both of the first and second input conduits at the same time.

6. The drinking apparatus of claim 5, wherein the valve member can be freely actuated by the user with the user's hand.

7. The drinking apparatus of claim 1, wherein the first input conduit is configured for placement in a first chamber of a drinking container, and the second input conduit is configured for placement in a second chamber of the drinking container, and wherein the first and second chambers are fluidly separated from each other.

8. The drinking apparatus of claim 7, wherein upon selective actuation of the rotatable valve member to the first position to provide for the first fluid being drawn only through the first input conduit, any fluid drawn back down through the output conduit is further drawn back down into the first input conduit, and wherein upon selective actuation of the rotatable valve member to the second position to provide for the second fluid being drawn only through the second input conduit, any fluid drawn back down through the output conduit is further drawn back down into the second input conduit.

9. The drinking apparatus of claim 1, the valve assembly further including an indicator to assist the user in the selection of one of the first, second, or third positions.

* * * * *